US009279335B2

(12) United States Patent
Propheter-Hinckley

(10) Patent No.: US 9,279,335 B2
(45) Date of Patent: Mar. 8, 2016

(54) VANE ASSEMBLY FOR A GAS TURBINE ENGINE

(75) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 826 days.

(21) Appl. No.: 13/196,980

(22) Filed: Aug. 3, 2011

(65) Prior Publication Data

US 2013/0034435 A1 Feb. 7, 2013

(51) Int. Cl.
*F01D 9/04* (2006.01)
*F01D 17/16* (2006.01)

(52) U.S. Cl.
CPC ..... *F01D 9/041* (2013.01); *F01D 17/162* (2013.01); *F05D 2250/30* (2013.01); *F05D 2250/70* (2013.01); *F05D 2250/73* (2013.01); *Y10T 29/49229* (2015.01)

(58) Field of Classification Search
CPC ..... F01D 25/246; F01D 17/162; F01D 9/041; F05D 2230/64; F05D 2260/30; F05D 2240/12; F04D 29/322; F04D 29/323
USPC ..... 415/191, 211.2, 209.1, 209.3, 210.1, 415/159, 160, 161; 416/205
See application file for complete search history.

(56) References Cited

U.S. PATENT DOCUMENTS 3,075,744 A 1/1963 Peterson
3,224,194 A 12/1965 Feo et al.
3,910,716 A 10/1975 Roughgarden et al.
3,966,352 A 6/1976 White et al.
4,013,377 A 3/1977 Amos
4,688,992 A 8/1987 Kirkpatrick et al.
5,222,863 A 6/1993 Jones
5,593,282 A 1/1997 Krueger
5,735,673 A 4/1998 Matheny et al.
5,931,636 A 8/1999 Savage et al.
7,168,919 B2 1/2007 Blatchford et al.
7,217,081 B2 5/2007 Scheurlen et al.
7,654,797 B2 2/2010 Boegli et al.
8,007,229 B2 8/2011 McCaffrey et al.
2004/0109762 A1 6/2004 Hidalgo et al.
2004/0141839 A1* 7/2004 Weaver ..... 415/210.1
2006/0078420 A1 4/2006 Barbe et al.
2009/0097966 A1* 4/2009 McCaffrey ..... 415/130
2009/0104022 A1 4/2009 Suliak, Jr. et al.
2010/0284815 A1 11/2010 Parker et al.

FOREIGN PATENT DOCUMENTS

EP 1967718 B1 5/2013

OTHER PUBLICATIONS

International Preliminary Report on Patentability for International Application No. PCT/US2013/025036 mailed Sep. 4, 2014.

* cited by examiner

*Primary Examiner* — Edward Look
*Assistant Examiner* — Juan G Flores
(74) *Attorney, Agent, or Firm* — Carlson, Gaskey & Olds

(57) ABSTRACT

A vane assembly for a gas turbine engine includes a first platform, a second platform, and an airfoil that extends radially across an annulus between the first platform and the second platform. The airfoil is centered relative to a centerline axis of the second platform and is offset relative to a centerline axis of the first platform.

18 Claims, 3 Drawing Sheets

VANE ASSEMBLY FOR A GAS TURBINE ENGINE

This invention was made with government support under Contract No. FA8650-09-D-2923-DO 0013 awarded by the United States Air Force. The government has certain rights in this invention.

BACKGROUND

This disclosure relates to a gas turbine engine, and more particularly to a vane assembly for a gas turbine engine.

Gas turbine engines, such as those which power modern commercial and military aircraft, typically include a compressor section, a combustor section and a turbine section. During operation, air is pressurized in the compressor section and is mixed with fuel and burned in the combustor section to generate hot combustion gases. The hot combustion gases are communicated through the turbine section which extracts energy from the hot combustion gases to power the compressor section and other gas turbine engine loads.

The compressor section and the turbine section of the gas turbine engine typically include alternating rows of rotating blades and stationary vanes. The rotating blades create or extract energy from the airflow that is communicated through the gas turbine engine, and the stationary vanes direct the airflow to a downstream row of blades. The plurality of vanes of each stage are annularly disposed and can be mechanically attached to form a full ring vane assembly. The vane assembly can include both stationary vanes and variable vanes.

SUMMARY

A vane assembly for a gas turbine engine includes a first platform, a second platform and an airfoil that extends radially across an annulus between the first platform and the second platform. The airfoil is centered relative to a centerline axis of the second platform and is offset relative to a centerline axis of the first platform.

In another exemplary embodiment, a vane assembly for a gas turbine engine includes a first platform, a second platform and a variable airfoil that extends between the first platform and the second platform. The first platform is skewed relative to the second platform such that a first portion of the variable airfoil is positioned entirely on a gas path of the first platform and a second portion of the variable airfoil extends beyond a mate face of the second platform.

In yet another exemplary embodiment, a method for providing a vane assembly for a gas turbine engine includes skewing a first platform of the vane assembly relative to a second platform of the vane assembly.

The various features and advantages of this disclosure will become apparent to those skilled in the art from the following detailed description. The drawings that accompany the detailed description can be briefly described as follows.

DETAILED DESCRIPTION

Figure 1:
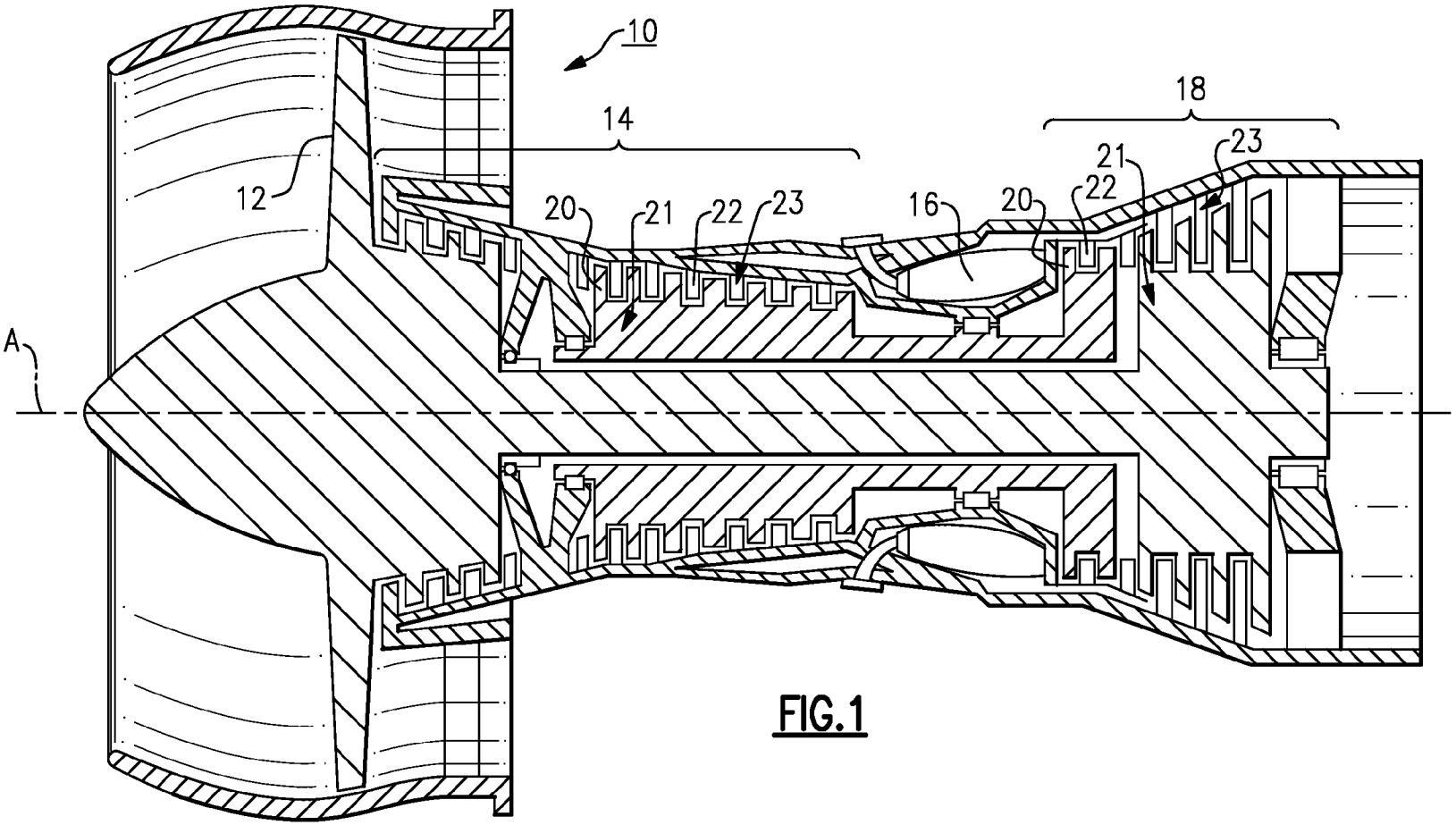
FIG. 1 shows a schematic view of a gas turbine engine.

FIG. 1 illustrates an example gas turbine 10 that is circumferentially disposed about an engine centerline axis A. The gas turbine engine 10 includes (in serial flow communication) a fan section 12, a compressor section 14, a combustor section 16, and a turbine section 18. During operation, air is compressed in the compressor section 14 and is mixed with fuel and burned in the combustor section 16. The combustion gases generated in the combustor section 16 are discharged through the turbine section 18, which extracts energy from the combustion gases to power the compressor section 14, the fan section 12 and other gas turbine engine loads.

The compressor section 14 and the turbine section 18 include alternating rows of rotor assemblies 21 and vane assemblies 23. The rotor assemblies 21 include a plurality of rotating blades 20, and each vane assembly 23 includes a plurality of vanes 22. The blades 20 of the rotor assemblies 21 create or extract energy (in the form of pressure) from the airflow that is communicated through the gas turbine engine 10. The vanes 22 direct airflow to the blades 20 to either add or extract energy.

This view is highly schematic and is included to provide a basic understanding of a gas turbine engine rather than limit the disclosure. This disclosure extends to all types of gas turbine engines and for all types of applications.

Figure 2:
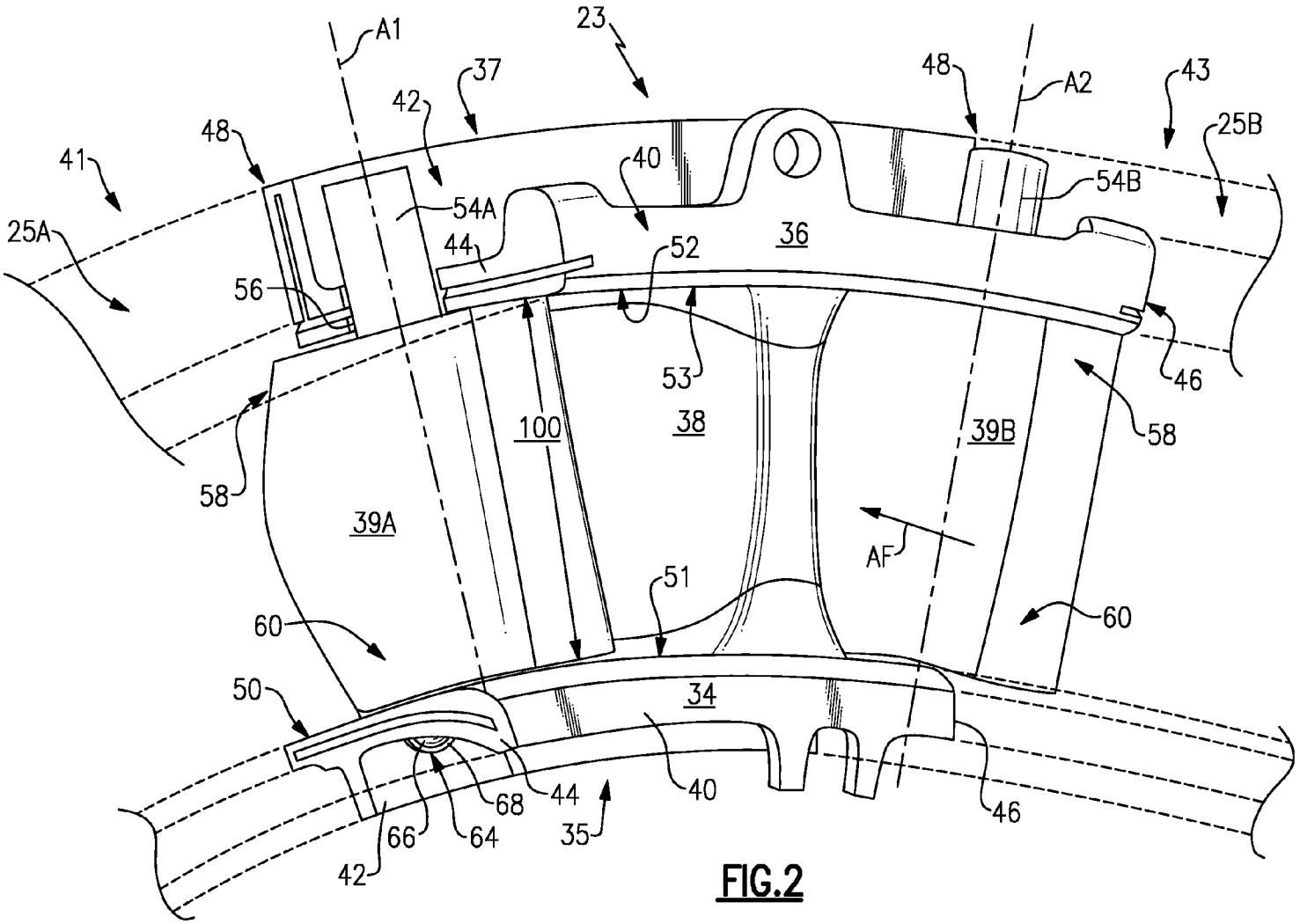
FIG. 2 illustrates a vane assembly of a gas turbine engine.

FIG. 2 illustrates an example vane assembly 23 of the gas turbine engine 10. In this example, the vane assembly 23 is a vane assembly of the turbine section 18. However, the vane assembly 23 could be incorporated into other sections of a gas turbine engine 10, including but not limited to, the compressor section 14.

A plurality of vane assemblies are mechanically attached to one another and annularly disposed about the engine centerline axis A to form a full ring vane assembly. The vane assembly 23 can include either fixed vanes (i.e., static vanes), variable vanes that rotate to change a flow area associated with the vane, or both, as is discussed in greater detail below.

The vane assembly 23 includes a first platform 34 and a second platform 36. One of the first platform 34 and the second platform 36 is positioned on an inner diameter side 35 of the vane assembly 23 and the other of the first platform 34 and the second platform 36 is positioned on an outer diameter side 37 of the vane assembly 23. A stationary airfoil 38 and variable airfoils 39A, 39B extend in span between the first platform 34 and the second platform 36. In other words, the stationary airfoil 38 and the variable airfoils 39A, 39B extend radially across an annulus 100 between the first platform 34 and the second platform 36.

The first platform 34 and the second platform 36 each include a leading edge rail 40, a trailing edge rail 42, and opposing mate faces 44, 46 that extend axially between the leading edge rails 40 and the trailing edge rails 42. Airflow AF is communicated in a direction from the leading edge rail 40 toward the trailing edge rail 42 during engine operation.

Additional vane assemblies 25A, 25B (shown in phantom) are positioned adjacent to the vane assembly 23, with the vane assembly 25A positioned at a first side 41 of the vane assembly 23 and the vane assembly 25B positioned on an opposite, second side 43 of the vane assembly 23. For simplicity, only portions of the vane assemblies 25A and 25B are illustrated by FIG. 2. A plurality of vane assemblies can be annularly disposed about the engine centerline axis A to form a full ring vane assembly.

The adjacent vane assemblies 23, 25A and 25B can be mechanically attached (e.g., bolted together) at the second platforms 36. It should be understood that an opposite configuration is contemplated in which the first platforms 34 are mechanically attached and the second platforms 36 are uncoupled.

A split line 48 (i.e., partition) is established between the adjacent vane assemblies 23, 25A and 25B. A radially outer surface 50 of the first platform 34 defines a gas path 51 of the first platform 34, and a radially inner surface 52 of the second platform 36 establishes a gas path 53 of the second platform 36. The gas paths 51, 53 of the first platform 34 and the second platform 36 extend across an entirety of the radially outer surface 50 and the radially inner surface 52 of the first and second platforms 34, 36, respectively.

The stationary airfoil 38 is integrally formed with at least one of (or both) the first platform 34 and the second platform 36. Therefore, the first platform 34 and the second platform 36 of the vane assembly 23 are coupled relative to one another. The variable airfoils 39A, 39B rotate relative to the first platform 34 and the second platform 36 about a first axis of rotation A1 and a second axis of rotation A2, respectively. The first axis of rotation A1 and the second axis of rotation A2 are generally perpendicular to the engine centerline axis A. The first axis of rotation A1 is transverse to the second axis of rotation A2. Put another way, the first axis of rotation A1 is two airfoil pitches away from the second axis of rotation A2 and the stationary airfoil 38 is one airfoil pitch away from the first axis of rotation A1, where an airfoil pitch is defined as the angle between two stacking axes of adjacent airfoils in a ring.

The variable airfoils 39A, 39B include rotational shafts 54A, 54B. The rotation shafts 54A, 54B extend from radially outer portions 58 of the variable airfoils 39A, 39B and are received in recesses 56 of the second platform 36. A radially inner portion 60 of the airfoils 39A, 39B could include a similar rotational connection arrangement.

Alternatively, the radially inner portion 60 of the variable airfoils 39A, 39B can include a ball and socket joint 64 for providing a range of motion relative to the first platform 34. In other words, the rotational shafts 54A, 54B can be eliminated on one side of the variable airfoils 39A, 39B. In this example, the variable airfoils 39A, 39B include a ball portion 66 of the ball and socket joint 64 and the first platform 34 defines a socket portion 68 of the ball and socket joint 64. The socket portion 68 rotationally receives the ball portion 66. The ball portion 66 can be either press-fit onto the variable airfoil 39A, 39B or integrally cast.

It should be understood that an opposite configuration is also contemplated in which the airfoils 39A, 39B define the socket portion 68 and the first platform 34 defines the ball portion 66. It should also be understood that the rotational shafts 54A, 54B could be positioned relative to the first platform 34, and the ball and socket joint 64 could be included at the second platform 36.

Figure 3:
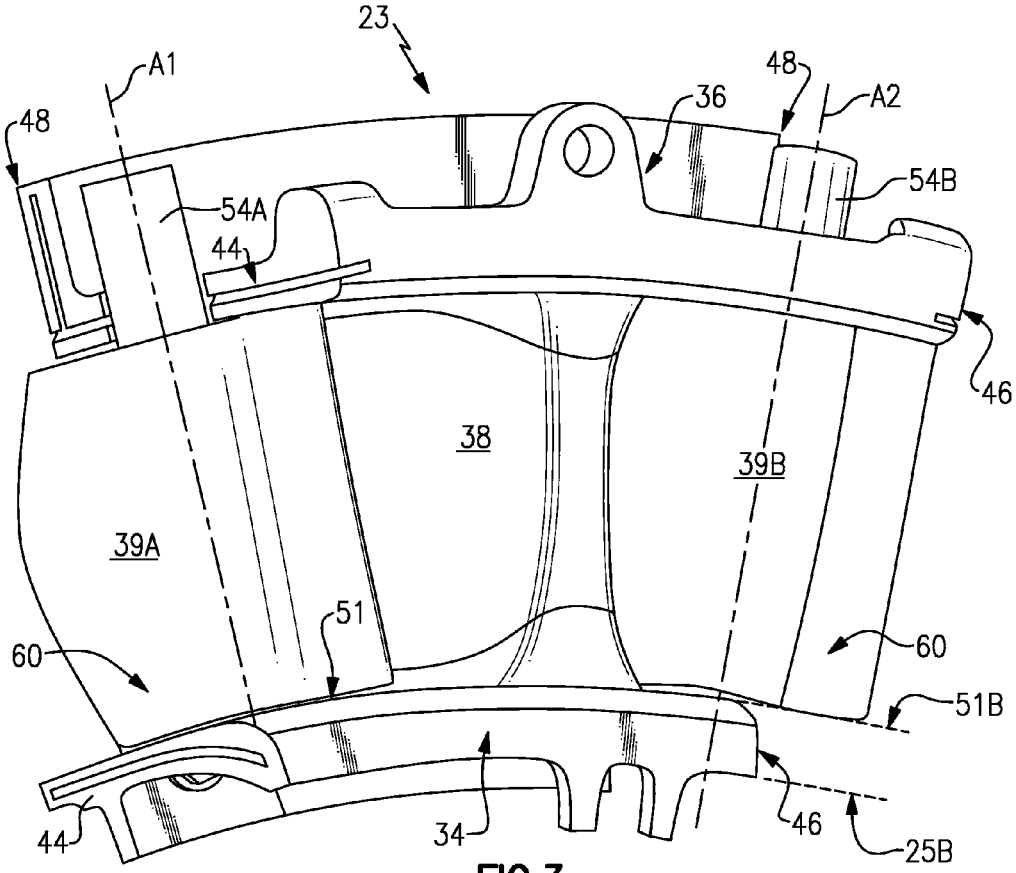
FIG. 3 illustrates a portion of the vane assembly of FIG. 2.

Referring to FIG. 3, the first platform 34 of the vane assembly 23 is skewed (i.e., distorted or biased) relative to the second platform 36. The first platform 34 is shifted counterclockwise relative to the second platform 36, or vice-versa, to skew the first platform 34 and the second platform 36 relative to one another. In this example, the mate face 44 of the first platform 34 is circumferentially skewed (in a counterclockwise direction) beyond the mate face 44 of the second platform 36, while the mate face 46 of the second platform 36 is circumferentially skewed (in a clockwise direction) beyond the mate face 46 of the first platform 34.

The skewed first and second platforms 34, 36 position a radially inner portion 60 of the variable airfoil 39A completely on the gas path 51 of the first platform 34. A radially inner portion 60 of the variable airfoil 39B extends circumferentially beyond the mate face 46 (i.e., beyond the periphery) of the first platform 34 such that it extends entirely on a gas path 51B of the adjacent vane assembly 25B and not on the gas path 51 of the first platform 34 of the vane assembly 23. An opposite arrangement could be provided where the first platform 34 and the second platform 36 are skewed in an opposition direction so long as the mate faces 44, 46 are offset relative to one another.

The axes of rotation A1 and A2 of the variable airfoils 39A, 39B are directly aligned with the split lines 48 of the vane assembly 23 as a result of the skewed nature of the first platform 34 and the second platform 36. In other words, the rotational shaft 54A, 54B are coplanar with the split lines 48.

Figure 4:
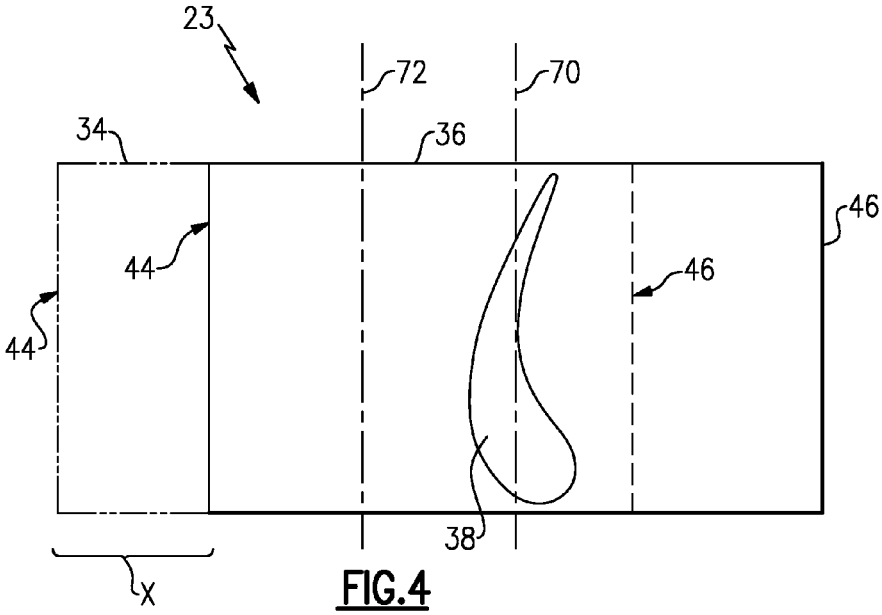
FIG. 4 illustrates a top view of the vane assembly of FIG. 3.

FIG. 4 illustrates a top view of the vane assembly 23. In this example, the first platform 34 and the second platform 36 are skewed relative to one another such that the mate faces 44, 46 of the first platform 34 are offset relative to the mate faces 44, 46 of the second platform 36. That is, a portion X of the first platform 34 circumferentially protrudes beyond the mate face 44 of the second platform 36. In this example, the stationary airfoil 38 is centered relative to a centerline axis 70 of the second platform 36 and is offset in a clockwise direction relative to a centerline axis 72 of the first platform 34.

The centerline axis 70 and the centerline axis 72 are generally parallel to the engine's centerline axis A. An opposite configuration is also contemplated in which the stationary airfoil 38 is centered relative to the first platform 34 and is offset (or non-centered) relative to the centerline axis 70 of the second platform 36.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

I claim:

1. A vane assembly for a gas turbine engine, comprising:

a first platform;

a second platform spaced from and circumferentially skewed relative to said first platform; and a variable airfoil that extends radially across an annulus between said first platform and said second platform, wherein one of a trailing edge, radially outer airfoil portion and a trailing edge, radially inner airfoil portion of said variable airfoil is positioned entirely on a gas path of said first platform and the other of said trailing edge, radially outer portion and said trailing edge, radially inner portion of said variable airfoil extends circumferentially beyond a mate face of said second platform.

2. The assembly as recited in claim 1, comprising a fixed airfoil positioned adjacent to said variable airfoil.

3. The assembly as recited in claim 2, comprising a second variable airfoil positioned on an opposite side of said fixed airfoil from said variable airfoil.

4. The assembly as recited in claim 3, wherein a first axis of rotation of said variable airfoil is transverse to a second axis of rotation of said second variable airfoil.

5. The assembly as recited in claim 4, wherein said first axis of rotation is two airfoil pitches away from said second axis of rotation.

6. The assembly as recited in claim 2, wherein said fixed airfoil is centered relative to a centerline axis of one of said first platform and said second platform and is offset relative to a centerline axis of the other of said first platform and said second platform.

7. The assembly as recited in claim 1, wherein said variable airfoil includes a rotational shaft at one of said first platform and said second platform and a ball and socket joint at the other of said first platform and said second platform.

8. The assembly as recited in claim 1, wherein said first platform and said second platform both establish a gas path on each of a suction side and a pressure side of said airfoil.

9. The assembly as recited in claim 1, wherein said trailing edge, radially inner airfoil portion extends on a gas path of an adjacent vane assembly.

10. The assembly as recited in claim 9, wherein said trailing edge, radially outer airfoil portion does not extend on said gas path of said adjacent vane assembly.

11. A vane assembly for a gas turbine engine, comprising:

a first platform;

a second platform; and a variable airfoil that extends between said first platform and said second platform, wherein said first platform and said second platform are circumferentially skewed relative to one another such that one of a radially outer airfoil portion and a radially inner airfoil portion of said variable airfoil does not circumferentially extend beyond a first mate face of one of said first platform and said second platform and the other of said radially outer airfoil portion and said radially inner airfoil portion of said variable airfoil extends circumferentially beyond a second mate face of the other of said first platform and said second platform.

12. The assembly as recited in claim 11, wherein one of said radially outer airfoil portion and said radially inner airfoil portion extends along a gas path of a platform of an adjacent vane assembly.

13. The assembly as recited in claim 11, wherein a rotational shaft of said variable airfoil is coplanar with a mate face of one of said first platform and said second platform.

14. The assembly as recited in claim 11, comprising a fixed airfoil adjacent to said variable airfoil.

15. The assembly as recited in claim 14, wherein said fixed airfoil is centered relative to one of said first platform and said second platform and is non-centered relative to the other of said first platform and said second platform.

16. A method for providing a vane assembly for a gas turbine engine, comprising the steps of:

circumferentially skewing a first platform of the vane assembly relative to a second platform of the vane assembly, wherein one of a trailing edge, radially outer airfoil portion and a trailing edge, radially inner airfoil portion of a variable airfoil is positioned entirely on a gas path of one of the first platform and the second platform and the other of the trailing edge, radially outer portion and the trailing edge, radially inner portion of the variable airfoil extends circumferentially beyond a mate face of the other of the first platform and the second platform.

17. The method as recited in claim 16, wherein the centerline axis of the first platform is offset from the centerline axis of the second platform.

18. The method as recited in claim 16, wherein the step of skewing includes extending a mate face of the first platform circumferentially beyond a mate face of the second platform.

* * * * *